US012698709B2

(12) United States Patent
Zhang et al.

(10) Patent No.: US 12,698,709 B2
(45) Date of Patent: Aug. 4, 2026

(54) SLIPFORM BLADE AND METHOD FOR APPLYING PRE-COMPRESSION STRAIN TO CAST-IN-PLACE CONCRETE ON WELL WALLS

(71) Applicant: China University of Mining and Technology, Xuzhou (CN)

(72) Inventors: Chi Zhang, Xuzhou (CN); Xinyu Yang, Xuzhou (CN); Weihao Yang, Xuzhou (CN); Jiahui Huang, Xuzhou (CN); Zhijiang Yang, Xuzhou (CN); Tao Han, Xuzhou (CN); Tao Zhang, Xuzhou (CN); Tingting Luo, Xuzhou (CN); Yu Zhang, Xuzhou (CN)

( * ) Notice: Subject to any disclaimer, the term of this patent is extended or adjusted under 35 U.S.C. 154(b) by 0 days.

(21) Appl. No.: 19/305,588

(22) Filed: Aug. 20, 2025

(65) Prior Publication Data

US 2026/0043330 A1 Feb. 12, 2026

(30) Foreign Application Priority Data

Jul. 1, 2025 (CN) ..... 202510896468.1

(51) Int. Cl.
*E21D 5/04* (2006.01)
*E21D 5/12* (2006.01)

(52) U.S. Cl.
CPC *E21D 5/12* (2013.01); *E21D 5/04* (2013.01)

(58) Field of Classification Search
CPC ..... E02D 29/10; E21D 5/12; E21D 5/04
See application file for complete search history.

(56) References Cited

U.S. PATENT DOCUMENTS 3,733,835 A * 5/1973 Jacobs ..... E21D 9/0621 405/142
4,129,991 A * 12/1978 Schaden ..... E21D 11/10 405/150.2

(Continued)

FOREIGN PATENT DOCUMENTS

CN 109736811 B * 8/2020
CN 114525812 B * 11/2023 ..... E02D 29/10

OTHER PUBLICATIONS

Yang et al. CN-114525812-B; Machine Translation; All; Nov. 2023 (Year: 2023).*

(Continued)

*Primary Examiner* — Benjamin F Fiorello

(57) ABSTRACT

The invention discloses a slipform blade foot and method for applying pre-compression strain to cast-in-place concrete of a shaft wall. The slipform blade foot is an annular structure, comprising a plurality of blade foot block structures connected end to end, each blade foot block structure comprising: a blade foot block body, a vertical displacement generating device, a displacement sensor and a limit plate, the vertical displacement generating device is arranged between a lower plate and an arc plate, and is used to drive the displacement of the arc plate in a vertical direction; the displacement sensor is arranged on the telescopic end of the vertical displacement generating device; the limit plate is an I-shaped structure, and is used to limit the maximum displacement distance of the arc plate. The invention is suitable for a shaft wall constructed by a top-down, short-digging and short-laying process, and can quickly and accurately apply pre-compression strain to the cast-in-place concrete of the shaft wall by applying upward displacement to the arc plate to extrude the cast-in-place concrete, thereby improving the compactness of the cast-in-place concrete in the shaft (Continued)

wall section and the joint cast-in-place concrete, and significantly improving the overall water-sealing performance of the shaft wall.

7 Claims, 5 Drawing Sheets

(56) References Cited

U.S. PATENT DOCUMENTS 4,371,290 A * 2/1983 Ivanov ..... E21D 11/102 405/150.1
4,391,549 A * 7/1983 Murray ..... E01C 19/4893 404/98
4,441,838 A * 4/1984 Cossart ..... E04G 11/02 405/290
4,450,666 A * 5/1984 Trumbull ..... F27D 1/1621 52/749.15
4,930,937 A * 6/1990 Fulton ..... E02D 29/045 249/11
12,247,488 B2 * 3/2025 Kern ..... E21D 11/105
2020/0002957 A1 * 1/2020 Mancini ..... E21D 11/102

OTHER PUBLICATIONS

Zheng et al. CN-109736811-B; Machine Translation; All; Aug. 2020 (Year: 2020).*
CNIPA First Office Action, Application No. 202510896468.1, issued Aug. 4, 2025, Chinese original, 3 pages.
CNIPA First Office Action, Application No. 202510896468.1, issued Aug. 4, 2025, English translation, 4 pages.

* cited by examiner

SLIPFORM BLADE AND METHOD FOR APPLYING PRE-COMPRESSION STRAIN TO CAST-IN-PLACE CONCRETE ON WELL WALLS

TECHNICAL FIELD

The present invention relates to the technical field of mine shaft and tunnel construction engineering, and in particular to a sliding form blade and method for applying pre-compression strain to cast-in-place concrete of a shaft wall.

BACKGROUND

For well or shaft walls constructed by top-down, short excavation and short masonry technology, including but not limited to existing single-layer shaft wall structures and outer shaft wall structures, as shown in FIGS. 1 and 2, a traditional slipform blade foot is generally composed of 4 to 8 steel structure blade foot blocks bolted or welded together. As shown in FIG. 3, each blade foot block is composed of upper plates, curved plates, outer plates, lower plates, reinforcing ribs, limit blocks, inner support ribs, inner plates and other components that are bolted or welded together, and the components cannot move relative to each other. The blade foot supports the weight of the slipform and the cast-in-place concrete in this section at the same time. Due to temperature stresses of cast-in-place concrete of the shaft wall, movements of the slipform blade foot, poor working performance of a concrete mix or insufficient vibration, the shaft wall concrete of some sections of a well or shaft wall often has water-conducting cracks and joint water-conducting cracks after hardening. The water-conducting cracks and joint water-conducting cracks in a section seriously weaken the water-sealing performance of the shaft wall, and in severe cases may induce water inrush or flooding accidents in the shaft.

During the construction of a shaft wall, applying pre-compression strain to the cast-in-place concrete of the shaft wall is an effective way to reduce the water-conducting cracks in the cast-in-place concrete shaft wall. The most common method is to use micro-expansion concrete to generate micro-expansion strain in the cast-in-place concrete, which is generally about 300 micro-strains. The expansion of the concrete is constrained to generate compressive strain. However, the value of the pre-compression strain generated by this technology in the cast-in-place concrete of the shaft wall depends on the amount of expansion agent added and the degree of constraint of the shaft wall concrete. The value of the pre-compression strain cannot be manually adjusted or controlled during the hardening of the concrete. Therefore, this technology is a passive and difficult to accurately control method for applying pre-compression strain to the cast-in-place concrete of the shaft wall.

In order to achieve the purpose of active control of pre-compression strain, there is also a method for applying pre-compression strain to concrete. Specifically, during the casting of the shaft wall concrete, a tool is used to manually tighten the nuts at the bottom of the vertical steel bars of each section. The nuts support the joint steel plate to produce an upward displacement, and the pre-compression strain is applied to the cast-in-place concrete of the shaft wall.

However, this method must use the nuts at the bottom of the steel bars and the joint steel plates to apply pre-compression strain to the cast-in-place concrete of the shaft wall, and is only applicable to "Single-layer shaft wall with joint plates and its construction method ZL200610088128.3". Moreover, since the tensioning force of a single steel bar is only 0.2 kN~0.52 kN, the tensioning force of the steel bar that can be generated by this method is very small, that is, the pre-compression strain that can be applied to the concrete is very small, and the value of the pre-compression strain cannot be accurately adjusted or controlled. And it takes at least 2 hours to manually tighten the nuts at the bottom of each section of vertical steel bars, which is time-consuming and labor-intensive. In short, it is difficult for the above methods to quickly and accurately apply pre-compression strain to the cast-in-place concrete of the shaft wall.

SUMMARY

The purpose of the present invention is to provide a slipform blade and method for applying pre-compression strain to cast-in-place concrete of a shaft wall, which is suitable for shaft walls constructed by top-down, short excavation and short masonry technology, and can quickly and accurately apply pre-compression strain to the cast-in-place concrete of the shaft wall, improve the compactness of cast-in-place concrete in the shaft wall section and the joint cast-in-place concrete, avoid the occurrence of water-conducting cracks in the section and joint water-conducting cracks in the shaft wall concrete after hardening, and finally significantly improve the overall water-sealing performance of the shaft wall.

The technical solution of the present invention is:

A slipform blade foot for applying pre-compression strain to cast-in-place concrete of a well wall with an annular structure, including a plurality of blade foot block structures connected end to end, wherein each of the blade foot block structures include: a blade foot block body, including: a lower plate; an outer plate, vertically arranged at one end of the lower plate; a blade foot block connecting plate, one end of which is connected to the other end of the lower plate; an upper plate, one end of which is connected to the other end of the blade foot block connecting plate, and wherein a hole groove is provided on the upper plate; an arc plate, one end of which slides on the outer plate through its lower edge structure, and the other end of which overlaps with the upper plate; a vertical displacement generating device, which is arranged between the lower plate and the arc plate, wherein the fixed end is fixedly connected to the lower plate, and the telescopic end is fixedly connected to the arc plate, and is used to drive the displacement of the arc plate in the vertical direction; a displacement sensor, which is arranged on the telescopic end of the vertical displacement generating device, and is used to monitor the vertical displacement value applied by the vertical displacement generating device in real time; wherein real-time monitoring of the vertical displacement h applied by the vertical displacement generating device is performed to ensure that h is not greater than L. When the stiffness of the arc plate is large enough, the vertical displacement of the arc plate as a whole is equal to the vertical displacement h applied by the vertical displacement generating device. The limit plate is an I-shaped structure with two horizontal surfaces and one vertical surface. One end of the horizontal surface of the limit plate is fixedly connected to one end of the arc plate, the vertical surface passes through the hole groove on the upper plate and is slidably connected to the hole groove, and the other horizontal surface is located below the upper plate. The dimensions of the two horizontal surfaces are both larger than the dimensions of the hole groove. The maximum upward displacement of the arc plate is equal to the length L of the limit plate beyond the upper plate.

Further, the arc plate is a steel structure. It is ensured that the arc plate will not deform during the entire process of the slipform blade applying pre-compression strain to the cast-in-place concrete of the vertical shaft wall.

Further, the vertical displacement generating device uses a hydraulically driven vertical displacement generating device. The hydraulic system can achieve high-precision control of displacement through a servo valve, which is more suitable for scenes such as concrete strain monitoring that require strict alignment or graded loading.

Furthermore, the cross section of the lower edge structure is L-shaped, wherein one end of the arc plate is connected to the outer side of the right angle position of the lower edge structure, the longer side of the lower edge structure is slidably connected to the inner plate surface of the outer plate, and the shorter side is overlapped with the end of the outer plate away from the lower plate.

Further disclosed is a method for applying prestressing strain to cast-in-place concrete on the shaft wall, using the above-mentioned slipform blade foot for construction, including the following steps:

S1: high excavation construction, after excavating a section height H, lower the slipform blade foot and align it; tie the steel bars, install the vertical formwork, and pour the concrete;

S11: for the height of cast-in-place concrete H, a prestressing strain value sis to be applied, with a corresponding vertical displacement h to be applied to the arc plate, wherein the vertical displacement h is determined by the section height H and the prestressing strain value ε to be applied, and h≤L, wherein L is the length of the limit plate beyond the lower edge of the upper plate;

S12: during the concrete pouring process, n concrete vertical strain gauge measurement points are evenly distributed within the section height H, and the measured strain values are: $\varepsilon_1, \varepsilon_2, \ldots, \varepsilon_n$; where 2≤n≤8. Where section height H=excavation section height=cast-in-place concrete height, the average vertical strain of concrete within the section height H range is $$\bar{\varepsilon} = \frac{1}{n}\sum_{i=1}^{n}\varepsilon_i;$$

where i is the number of the measuring point, and $\varepsilon_i$ is the vertical concrete strain value measured at the i-th measuring point, and each concrete vertical strain gauge measuring point measures the vertical strain of concrete through a concrete strain gauge. The concrete strain gauge can be tied to the vertical steel bar. The test cable of the concrete strain gauge is led out and connected to the test instrument to measure the strain reading. This is an existing technical means and will not be elaborated here.

S2: After the initial setting of the concrete and before the final setting, according to the pre-compression strain value ε to be applied, the vertical displacement generating device is operated to drive the arc plate to apply an upward vertical displacement h. Until demolding, the arc plate maintains the vertical displacement value unchanged.

During the pre-stressing strain application process in S21, the control program is used to monitor and calculate the $\bar{\varepsilon}$ value in real time, and the vertical displacement h applied to the arc plate by computer feedback and the vertical displacement generating device is used to keep the ε value at the target value ε.

Further, during the pre-stressing strain application process, the control method for keeping the $\bar{\varepsilon}$ value at the target value ε in S21 includes the following steps:

S211: initialization: determine the target pre-stressing strain value ε to be applied; reset the vertical displacement h applied to the arc plate by the vertical displacement generating device to zero; set the allowable error $\Delta\varepsilon=\varepsilon-\bar{\varepsilon}$.

S212: real-time measurement and calculation: read the concrete vertical strain value $\varepsilon_n$ in real time through the concrete strain gauge buried in the concrete, and calculate the average vertical strain $\bar{\varepsilon}$ of the concrete within the range of the segment height H.

If $\bar{\varepsilon}<\varepsilon-\Delta\varepsilon$, the vertical displacement generating device is driven to increase the vertical displacement h of the arc plate.

If $\bar{\varepsilon}>\varepsilon+\Delta\varepsilon$, the vertical displacement generating device is driven to reduce the vertical displacement h of the arc plate.

If $\bar{\varepsilon}$ is within the allowable error range, the current vertical displacement h of the arc plate is maintained.

S213: When the system reaches a stable state and $\bar{\varepsilon}$ always remains within the allowable error range of the target value ε, stop adjusting the vertical displacement generating device.

Further, the control method also includes:

Limiting the maximum displacement of the vertical displacement generating device, h≤L.

When $\bar{\varepsilon}$≤500 microstrain, the vertical displacement generating device is cut off to avoid crushing the cast-in-place concrete.

Compared with the prior art, the beneficial effects of the present invention are as follows:

During the process of pouring concrete on a shaft wall constructed by top-down, short excavation and short masonry technology, the present invention controls the vertical displacement generating device to drive the vertical displacement of the arc plate, applying upward displacement to the arc plate to squeeze the cast-in-place concrete, generating pre-compression strain inside the cast-in-place concrete. This can improve the compactness of cast-in-place concrete and joint cast-in-place concrete in shaft wall sections, avoid the occurrence of water-conducting cracks in each section and water-conducting cracks in the joints of the shaft wall concrete after hardening, and finally significantly improve the overall water-sealing performance of the shaft wall.

In addition, during the process of applying large pre-compression strains, the present invention reads the vertical strain of different sections of the concrete in real time through the concrete strain gauge, calculates the average vertical strain, compares the average vertical strain with the vertical strain of the target value, and operates the vertical displacement generating device to drive the arc plate, so that the average vertical strain is always kept within the vertical strain allowable error range of the target value, so as to ensure that the concrete pre-compression strain value ε is 300 microstrain~500 microstrain, thus reducing the risk of concrete cracking.

Among them, 1, arc plate, 2, lower plate, 3, outer plate, 4, upper plate, 5, blade foot block connecting plate, 6, vertical displacement generating device, 7, displacement sensor, 8, limit plate.

DETAILED DESCRIPTION OF EMBODIMENTS

The specific implementation of the present invention is described in detail below in conjunction with FIGS. 1 to 5. In the description of the present invention, it should be understood that the terms "center", "up", "down", "front", "back", "left", "right", "vertical", "horizontal", "top", "bottom", "inside", "outside" and the like indicate the orientation or position relationship based on the orientation or position relationship shown in the accompanying drawings, which is only for the convenience of describing the present invention and simplifying the description, rather than indicating or implying that the device or element referred to must have a specific orientation, be constructed and operated in a specific orientation, and therefore cannot be understood as a limitation on the present invention.

It should be noted that the circuit connections involved in the present invention all adopt conventional circuit connection methods and do not involve any innovation.

EMBODIMENT

Figure 1:
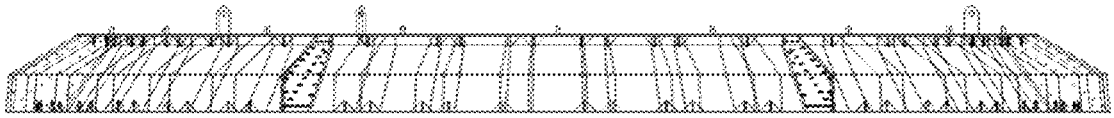
FIG. 1 is a perspective view of a traditional blade foot structure.
Figure 2:
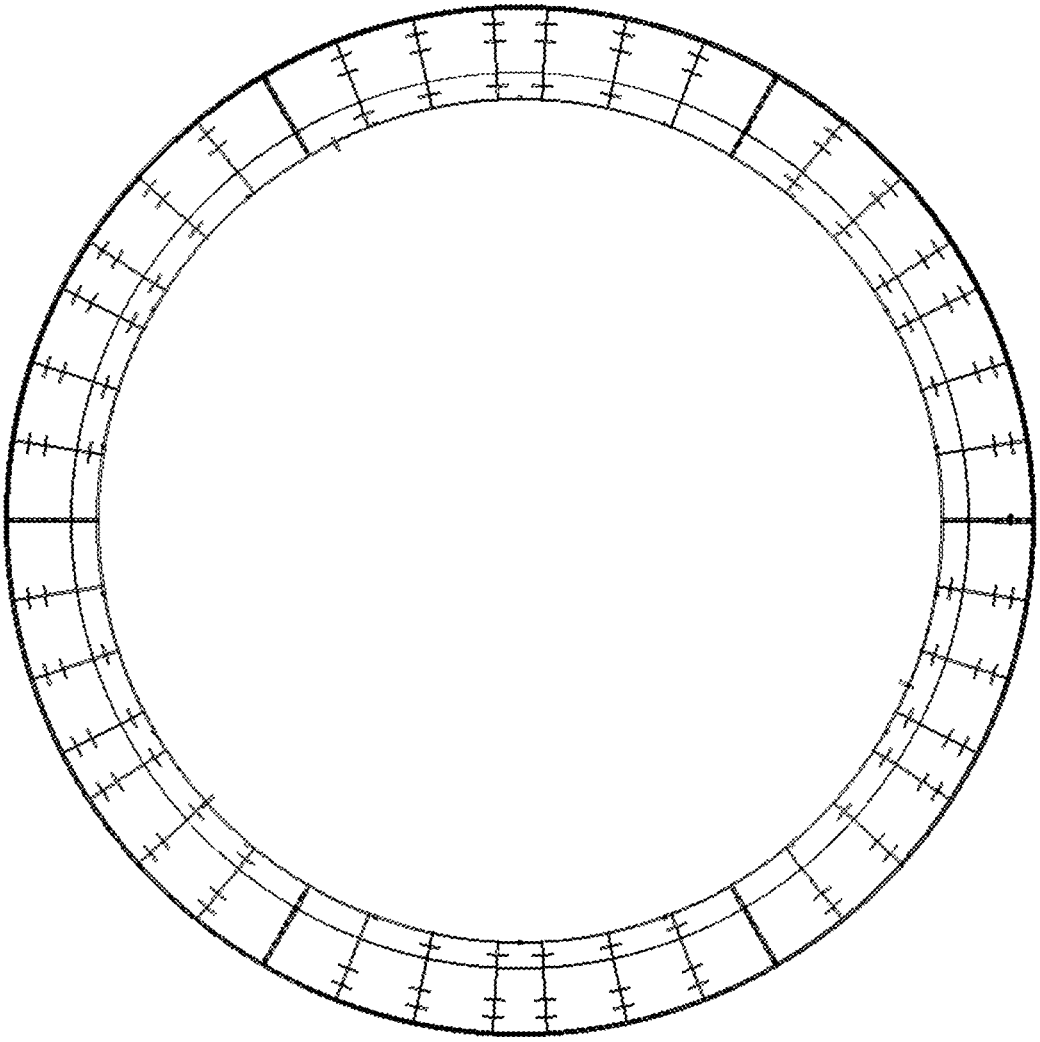
FIG. 2 is a top view of a traditional blade foot structure.
Figure 3:
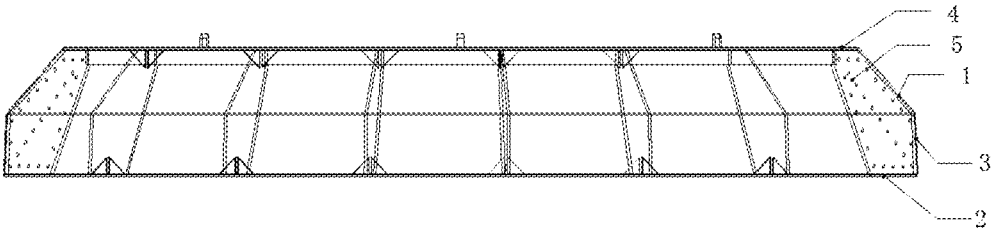
FIG. 3 is a perspective view of a traditional blade foot block structure.
Figure 4:
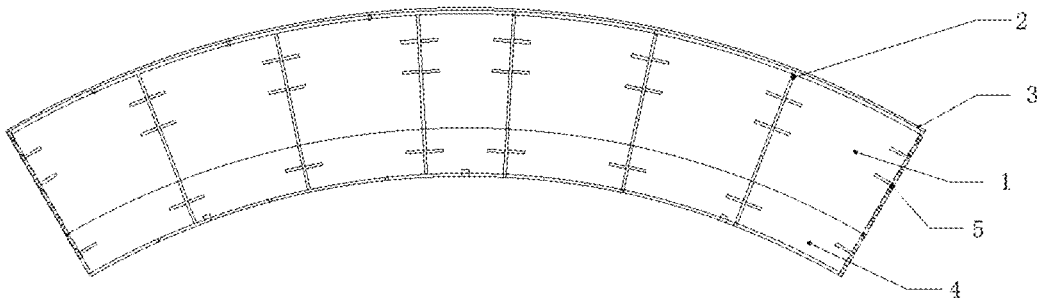
FIG. 4 is a top view of a traditional blade foot block structure.
Figure 5:
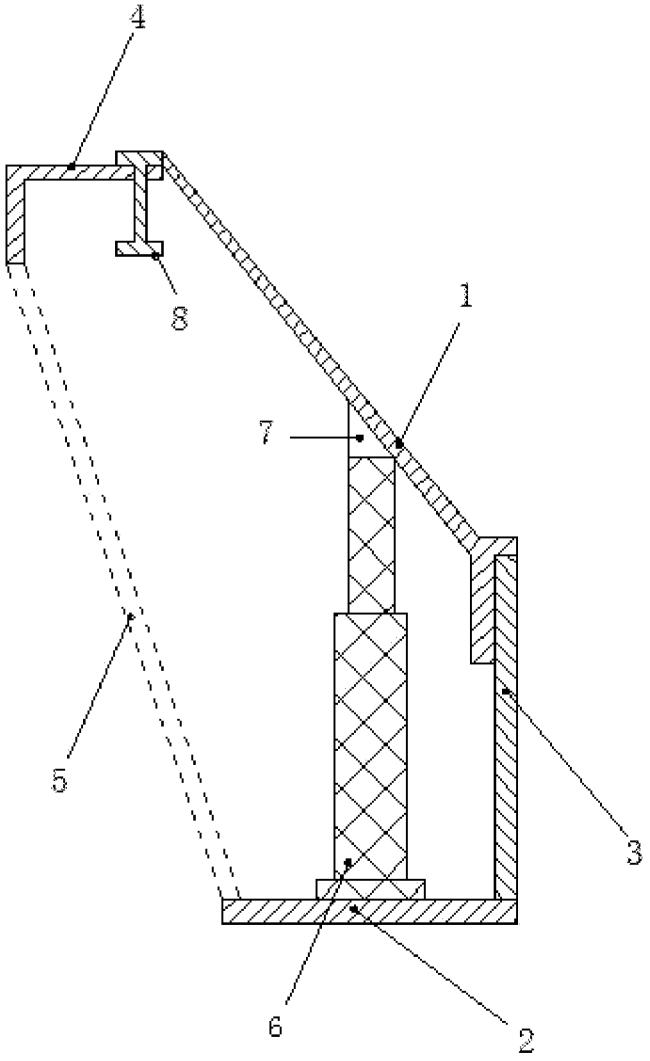
FIG. 5 is a cross-sectional view of a schematic diagram of the blade foot block structure of the present invention.

A slipform blade foot for applying pre-compression strain to cast-in-place concrete on the well wall has the same blade foot block connection structure as the traditional blade foot structure, both of which are annular structures, and both include multiple blade foot block structures connected end to end, and adjacent blade foot block structures are connected by bolts. In this embodiment, each blade foot block structure of a slipform blade foot for applying pre-compression strain to cast-in-place concrete on the well wall includes: a blade foot block body, a vertical displacement generating device 6, a displacement sensor 7 and a limit plate 8, as shown in FIG. 5. The blade foot block body comprises: a lower plate 2, an outer plate 3, a blade foot block connecting plate 5, an upper plate 4 and a curved plate 1, wherein the outer plate 3 is vertically arranged at one end of the lower plate 2; one end of the blade foot block connecting plate 5 is connected to the other end of the lower plate 2; one end of the upper plate 4 is connected to the other end of the blade foot block connecting plate 5, and a hole groove is provided on the upper plate 4; one end of the curved plate 1 slides on the outer plate 3 through its lower edge structure, and the other end overlaps with the upper plate 4; the cross section of the lower edge structure is L-shaped, one end of the curved plate 1 is connected to the outer side of the right angle position of the lower edge structure, is slidably connected to the inner plate surface of the outer plate 3, and the shorter side is overlapped with the end of the outer plate 3 away from the lower plate 2, and cooperates with the limit plate 8 to keep the arc plate 1 sliding in the vertical direction; the vertical displacement generating device 6 is arranged between the lower plate 2 and the arc plate 1, the fixed end is fixedly connected to the lower plate 2, and the telescopic end is fixedly connected to the arc plate 1, which is used to drive the displacement of the arc plate 1 in the vertical direction. The vertical displacement generating device 6 is selected from one of the pneumatic drive, hydraulic drive and electric drive that can be controlled by an external controller. This embodiment selects a hydraulically driven vertical displacement generating device 6. Since the hydraulic system can achieve high-precision control of the displacement through a servo valve, it is more suitable for scenes such as concrete strain monitoring that require strict alignment or graded loading; the displacement sensor 7 is arranged on the telescopic end of the vertical displacement generating device 6, which is used to monitor the vertical displacement value applied by the vertical displacement generating device 6 in real time; when the stiffness of the arc plate 1 is large enough, the overall upward vertical displacement of the arc plate 1 is equal to the vertical displacement h applied by the vertical displacement generating device 6. The vertical displacement generating device 6 is controlled to drive the arc plate 1 to vertically displace, and the arc plate 1 is subjected to an upward displacement to squeeze the cast-in-place concrete, which will generate pre-compression strain inside the cast-in-place concrete. The limit plate 8 is an I-shaped structure with two horizontal surfaces and one vertical surface. One end of one horizontal surface of the limit plate 8 is fixedly connected to one end of the arc plate 1, and the vertical surface passes through the hole groove on the upper plate 4 and is slidably connected to the hole groove. The other horizontal surface is located below the upper plate 4, and the dimensions of the two horizontal surfaces are larger than the dimensions of the hole groove. The displacement sensor 7 monitors the vertical displacement h applied by the vertical displacement generating device 6 in real time to ensure that h is not greater than L, that is, the maximum upward displacement of the arc plate 1 is equal to the length L of the limit plate 8 exceeding the upper plate 4.

The vertical displacement generating device 6 is controlled by the hydraulic system to drive the arc plate 1 to achieve precise vertical displacement, so as to more accurately apply upward displacement to the arc plate 1 to squeeze the cast-in-place concrete, and a pre-compression strain will be generated inside the cast-in-place concrete, which can improve the compactness of the cast-in-place concrete in the well wall section and the joint cast-in-place concrete, and avoid the occurrence of water-conducting cracks in the well wall concrete and the joint water-conducting cracks after hardening, and finally significantly improve the overall water sealing performance of the well wall.

In order to ensure that the arc plate 1 will not deform during the entire process of the slipform blade applying pre-compression strain to the cast-in-place concrete of the vertical well wall, the arc plate 1 of this embodiment is a steel structure.

A method for applying prestressing strain to cast-in-place concrete on the shaft wall, using the above-mentioned slipform blade foot for construction, including the following steps:

S1: high excavation construction, after the excavated section depth is equal to H, lower the slipform blade foot and align it; tie the steel bars, install the vertical formwork, and pour concrete;

S11: the height of the cast-in-place concrete is H, the prestressing strain value to be applied is ε, the vertical displacement to be applied to the arc plate 1 is h, the vertical displacement h is determined by the section height H and the prestressing strain value ε, with the constraint that h≤L, where Lis the length of the limit plate 8 beyond the lower edge of the upper plate 4;

S12: during the concrete pouring process, n concrete vertical strain gauge measurement points are evenly distributed within the section height H, and the measured strain values are: $\varepsilon_1, \varepsilon_2, \ldots, \varepsilon_n$; where 2≤n≤8, and section height H=excavation section height=cast-in-place concrete height; the average vertical strain of concrete within the section height H range is calculated as $$\bar{\varepsilon} = \frac{1}{n}\sum_{i=1}^{n}\varepsilon_i;$$

where i is the number of the measuring point, and $\varepsilon_i$ is the vertical concrete strain value measured at the i-th measuring point;

In this embodiment, His 2 m~4 m, and the pre-compression strain value ε is 300 microstrain~500 microstrain; the vertical displacement to be applied to the arc plate 1 is calculated as h≈εH, and h≤L, wherein L is the length of the limit plate 8 beyond the lower edge of the upper plate 4.

If there are too few measuring points, for example, 1 to 2 measuring points, it may be difficult to accurately reflect the true form of the strain distribution. If there are too many measuring points, for example, 5 to 8 measuring points, it will not only increase the layout cost and data processing complexity, but also have limited improvement on accuracy. Therefore, in this embodiment, three concrete vertical strain gauge measuring points are evenly distributed within the range of segment height H. The vertical heights of the three concrete vertical strain gauge measuring points are H/4, H/2 and 3H/4 respectively. The vertical concrete strain values measured by the three measuring points are $\varepsilon_1$, $\varepsilon_2$ and $\varepsilon_3$ respectively, can effectively capture the nonlinear strain gradient caused by the deadweight, shrinkage or external load of concrete. For example, the bottom is compressed and the top is tensile. In this example, the average vertical strain of concrete within the range of segment height H is $$\bar{\varepsilon} = \frac{1}{3}\sum_{i=1}^{3}\varepsilon_i;$$

each concrete vertical strain gauge measuring point measures the vertical strain of concrete through a concrete strain gauge. The concrete strain gauge can be tied to the vertical steel bar. The test cable of the concrete strain gauge is led out and connected to the test instrument to measure the strain reading. This is a prior art method and will not be elaborated here.

S2: After the initial setting of concrete and before the final setting, generally 2 to 6 hours after the concrete is poured, according to the pre-stressing strain value ε to be applied, the vertical displacement generating device 6 is operated to drive the arc plate 1 to apply the upward vertical displacement h. Before demolding, the arc plate 1 maintains the vertical displacement value unchanged.

S21: During the application of pre-stressing strain, the control program is used to monitor and calculate the $\bar{\varepsilon}$ value in real time, and the vertical displacement h applied to the arc plate 1 by computer feedback and the vertical displacement generating device 6 is used to keep the $\bar{\varepsilon}$ value at the target value ε.

The vertical strain at different heights of the concrete is read in real time by the concrete strain gauge, and the average vertical strain is calculated. The average vertical strain is compared with the vertical strain of the target value, and the vertical displacement generating device 6 is operated to drive the arc plate 1 so that the average vertical strain is always kept within the vertical strain allowable error range of the target value, so as to ensure that the concrete pre-stressing strain value ε is 300 microstrain~500 microstrain, thereby reducing the risk of concrete cracking.

S21: During the prestressing strain application process, the control method for keeping the $\bar{\varepsilon}$ value at the target value ε includes the following steps:

S211: Initialization: Determine the prestressing strain value ε to be applied to the target. The vertical displacement h applied by the vertical displacement generating device 6 to the arc plate 1 is reset to zero. Set the allowable error $\Delta\varepsilon=\varepsilon-\bar{\varepsilon}$.

S212: Real-time measurement and calculation: The concrete vertical strains $\varepsilon_1$, $\varepsilon_2$ and $\varepsilon_3$ are read in real time by the concrete strain gauge buried in the concrete, and the average vertical strain $\bar{\varepsilon}$ of the concrete within the range of segment height His calculated.

If $\bar{\varepsilon}<\varepsilon-\Delta\varepsilon$, the vertical displacement generating device 6 is driven to increase the vertical displacement h of the arc plate 1;

If $\bar{\varepsilon}>\varepsilon+\Delta\varepsilon$, the vertical displacement generating device 6 is driven to reduce the vertical displacement h of the arc plate 1;

If $\bar{\varepsilon}$ is within the allowable error range, the current vertical displacement h of the arc plate 1 is maintained;

S213 When the system reaches a stable state and $\bar{\varepsilon}$ always remains within the allowable error range of the target value ε, stop adjusting the vertical displacement generating device 6.

In some embodiments, the control method further includes:

Limiting the maximum displacement of the vertical displacement generating device 6, h≤L.

When $\bar{\varepsilon}$≤500 microstrain, the vertical displacement generating device 6 is stopped immediately to avoid crushing the cast-in-place concrete.

The above disclosure is only a few preferred specific embodiments of the present invention, but the embodiments of the present invention are not limited thereto, and any changes that can be thought of by technicians in this field should fall within the scope of protection of the present invention.

What is claimed is:

1. A slipform blade foot having an annular structure, for applying prestressing strain to cast-in-place concrete of a shaft wall, comprising a plurality of blade foot block structures connected end to end, wherein each blade foot block structure comprises:

a blade foot block body, comprising:

a lower plate (2);

an outer plate (3), vertically arranged at a first end of the lower plate (2);

a blade foot block connecting plate (5), wherein a first end of the connecting plate (5) is connected to a second end of the lower plate (2);

an upper plate (4), wherein a first end of the upper plate (5) is connected to a second end of the connecting plate (5), and wherein the upper plate (4) comprises a hole groove;

an arc plate (1), wherein one end of the arc plate (1) slidably engages the outer plate (3) via a lower edge structure, and a second end of the arc plate (1) overlaps with the upper plate (4);

a vertical displacement generating device (6), disposed between the lower plate (2) and the arc plate (1), wherein:

a fixed end of the device (6) is fixedly connected to the lower plate (2);

a telescopic end of the device (6) is fixedly connected to the arc plate (1);

the device (6) is configured to drive the vertical displacement of the arc plate (1);

a displacement sensor (7) arranged on the telescopic end of the vertical displacement generating device (6), which configured to monitor the vertical displacement in real time;

a limit plate (8) having an I-shaped structure with two horizontal surfaces and one vertical surface, wherein:

a first horizontal surface of the limit plate (8) is fixedly connected to the arc plate (1);

the vertical surface passes through the hole groove of the upper plate (4) and is slidably connected to the hole groove;

a second horizontal surface is located below the upper plate (4), and wherein both of the horizontal surfaces are larger than the hole groove.

2. The slipform blade foot of claim 1, wherein the arc plate (1) is a steel structure.

3. The slipform blade foot of claim 1, wherein the vertical displacement generating device (6) is selected from one of a pneumatic drive, an hydraulic drive and an electric drive that can be controlled by an external controller.

4. The slipform blade foot of claim 1, wherein the lower edge structure has an L-shaped cross-section, and wherein:

a first end of the arc plate (1) is connected an outer side of a right-angle portion of the lower edge structure;

a longer side of the lower edge structure is slidably connected to an inner surface of the outer plate (3);

a shorter side of the lower edge structure overlaps an end of the outer plate (3) distal to the lower plate (2).

5. A method for applying prestressing strain to cast-in-place concrete on a shaft wall using the slipform blade foot of claim 4, comprising:

S1: performing high excavation construction, wherein, after excavating to a section height H, the slipform blade foot is lowered and aligned, steel bars are tied, vertical formwork is installed, and concrete is poured;

S11: determining parameters, wherein the height of the cast-in-place concrete is H, the target prestressing strain value is $\varepsilon$; the vertical displacement to be applied to the arc plate (1) is h, and the vertical displacement h is determined according to the section height H and the prestressing strain value $\varepsilon$, wherein $h \approx \varepsilon H$, and wherein $h \leq L$, wherein L is the length of the limit plate (8) extending beyond the lower edge of the upper plate (4);

S12: distributing n strain gauge measuring points, wherein, during the concrete pouring process, n concrete vertical strain gauge measuring points are distributed evenly within the section height H, and the strain values measured are: $\varepsilon_1, \varepsilon_2, \ldots, \varepsilon_n$; wherein, $2 \leq n \leq 8$, wherein, for section height H the average vertical strain of concrete within the range is $$\bar{\varepsilon} = \frac{1}{n}\sum_{i=1}^{n}\varepsilon_i$$

where i is the number of the measuring point and $\varepsilon_i$ is the vertical concrete strain value measured at the i-th measuring point;

S2: operating the vertical displacement generating device (6), wherein, from initial setting to final setting of the concrete, the vertical displacement generating device (6) is operated to drive the arc plate (1) to apply an upward vertical displacement h, according to the pre-stressing strain value $\varepsilon$ to be applied, wherein, before demolding, the arc plate (1) maintains constant vertical displacement;

S21: monitoring and calculation of the $\bar{\varepsilon}$ value, wherein, during the application of the pre-stressing strain, the control program is used to monitor and calculate the $\bar{\varepsilon}$ value in real time, and the vertical displacement h applied to the arc plate (1) by the vertical displacement generating device (6) is fed back by the computer to keep the $\bar{\varepsilon}$ value at the target value $\varepsilon$.

6. A method for applying prestressing strain to cast-in-place concrete on a shaft wall according to claim 5, wherein, during the process of applying prestressing strain, the control method in S21 to keep the $\bar{\varepsilon}$ value at the target value $\varepsilon$ comprises:

S211: initializing by:

determining the target prestressing strain value $\varepsilon$;

resetting the vertical displacement h applied by the vertical displacement generating device (6) to the arc plate (1) to zero;

setting the allowable error $\Delta\varepsilon = \varepsilon - \bar{\varepsilon}$;

S212: real-time adjustment, comprising:

reading the concrete vertical strain value $\varepsilon_n$, wherein the average vertical strain $\bar{\varepsilon}$ of the concrete within the range of the segment height H is calculated;

wherein, if $\bar{\varepsilon} < \varepsilon - \Delta\varepsilon$, the vertical displacement generating device (6) is driven to increase the vertical displacement h of the arc plate (1);

if $\bar{\varepsilon} > \varepsilon + \Delta\varepsilon$, the vertical displacement generating device (6) is driven to reduce the vertical displacement h of the arc plate (1);

if $\bar{\varepsilon}$ is within the allowable error range, the current vertical displacement h of the arc plate (1) is maintained;

S213: ceasing adjustment of the vertical displacement generating device (6) when the system reaches a stable state and $\bar{\varepsilon}$ always remains within the allowable error range of the target value $\varepsilon$.

7. A method for applying prestressing strain to cast-in-place concrete on a shaft wall according to claim 6, comprising:

limiting the maximum displacement of the vertical displacement generating device (6), $h \leq L$;

wherein, if $\bar{\varepsilon} \leq 500$ microstrain, the vertical displacement generating device (6) is immediately cut off to avoid crushing the cast-in-place concrete.

* * * * *